US010976015B1

(12) United States Patent
Gershaw et al.

(10) Patent No.: US 10,976,015 B1
(45) Date of Patent: Apr. 13, 2021

(54) TROFFER LIGHT FIXTURE AND METHOD OF INSTALLATION

(71) Applicant: TADD, LLC, Cary, IL (US)

(72) Inventors: David Gershaw, Charlestown, MA (US); Daniel Lajoie, Wakefield, MA (US); Li Juan, Zhongshan (CN); Hou Baolin, Zhongshan (CN)

(73) Assignee: TADD, LLC, Cary, IL (US)

( * ) Notice: Subject to any disclaimer, the term of this patent is extended or adjusted under 35 U.S.C. 154(b) by 0 days.

(21) Appl. No.: 16/676,147

(22) Filed: Nov. 6, 2019

(51) Int. Cl.
*F21S 8/02* (2006.01)
*F21V 15/01* (2006.01)
*F21Y 115/10* (2016.01)

(52) U.S. Cl.
CPC ..... *F21S 8/026* (2013.01); *F21V 15/012* (2013.01); *F21Y 2115/10* (2016.08)

(58) Field of Classification Search
CPC ..... F21S 8/026; F21S 8/028; F21V 21/041; F21V 21/042; F21V 21/044; F21V 21/045; F21V 21/046; F21V 21/048; F21V 21/049
See application file for complete search history.

(56) References Cited

U.S. PATENT DOCUMENTS 9,182,091 B2 11/2015 Gershaw
9,206,948 B1 12/2015 Scribante et al.
9,488,348 B2 11/2016 Scribante et al.
9,927,072 B2 3/2018 Scribante et al.
10,012,352 B2 7/2018 Scribante et al.
10,036,514 B2 7/2018 Scribante et al.
10,174,915 B2 1/2019 Scribante et al.
10,683,993 B2 * 6/2020 Green ..... F21S 8/026
10,704,751 B2 * 7/2020 Luo ..... F21V 29/70
2015/0267873 A1 * 9/2015 Price ..... F21V 21/03 362/235
2015/0338084 A1 * 11/2015 Ryder ..... F21V 29/74 362/606
2019/0128488 A1 * 5/2019 Trang ..... F21S 8/026
2019/0170341 A1 * 6/2019 Lax ..... F21V 17/12
2019/0277464 A1 * 9/2019 Won ..... F21V 23/003
2020/0173612 A1 * 6/2020 Zhang ..... F21S 8/043
2020/0256543 A1 * 8/2020 Stange ..... F21V 17/164

* cited by examiner

*Primary Examiner* — William N Harris
(74) *Attorney, Agent, or Firm* — Clark Hill PLC; James R. Foley

(57) ABSTRACT

A troffer light fixture that is easy to install, requires no brackets to have an acceptable appearance with regard to an existing, previously installed troffer housing, and can be used as a retrofit or as a new installation. The troffer light fixture includes one or more mechanisms with which a user can interact to extend or retract arms that are provided on the back side of the troffer light fixture. These arms work to secure the troffer light fixture in place relate to a ceiling, and when retracted provide that the troffer light fixture can be easily removed from the ceiling. The mechanism can take many forms, but in one embodiment can be provided as being a gear that meshes with gear racks that are provided on the arms.

53 Claims, 21 Drawing Sheets

TROFFER LIGHT FIXTURE AND METHOD OF INSTALLATION

BACKGROUND

The invention generally relates to troffer light fixtures, and more specifically relates to a troffer light fixture that is easy to install and can be used as a new installation or as a retrofit to an existing troffer light fixture.

A troffer light fixture typically includes a housing that is like a tray having a top wall and four sidewalls, and is either rectangular or square. The troffer housing is configured to be installed in a ceiling, such as a dropped ceiling having T-bars. Lamp sockets are typically mounted to the troffer housing, and the lamp sockets are connected to a ballast that receives electrical power from wiring within the ceiling. The troffer light fixture may further include a door that attaches to the troffer housing and opens downward, and the door often includes a lens that also opens downward.

With regard to retrofitting an existing troffer light fixture, this is often done in the industry for many reasons. For example, one may want to transition to a more efficient light source, such as by going from fluorescent bulbs to LED. Another reason may be because an existing troffer light fixture has damaged components, such as defective sockets or a defective ballast, or the existing troffer light fixture may have a dented housing.

Regardless of the reason for retrofitting, it is typically more desirable to retrofit an existing, previously installed troffer light fixture than it is to merely swap out the entire light fixture because swapping out the entire light fixture typically causes disruption of the ceiling, such as the release of debris and dust, etc. which is undesirable.

Many retrofit troffer light fixtures that exist in the industry are not easy to install. Additionally, many are provided as kits and include brackets that are used for installation purposes as well as to cover space that exists between the existing troffer housing and the new fixture.

SUMMARY

An object of an embodiment of the present invention is to provide a troffer light fixture that is easy to install.

Another object of an embodiment of the present invention is to provide a troffer light fixture that does not require the use of any extra, non-built in brackets to have an acceptable appearance with regard to an existing, previously installed troffer housing.

Still another object of an embodiment of the present invention is to provide a troffer light fixture that can be used as a retrofit or as a new installation.

Briefly, an embodiment of the present invention provides a troffer light fixture that includes a housing having a back side. A blade is provided on the back side of the housing for pinching a T-bar of a dropped ceiling. The back side also includes arms which are extendable to engage T-bars of a dropped ceiling. Preferably, the arms are extendable and retractable via user-interaction with a mechanism that is accessible from a front side of the housing.

BRIEF DESCRIPTION OF THE DRAWINGS

The organization and manner of the structure and operation of the invention, together with further objects and advantages thereof, may best be understood by reference to the following description taken in connection with the accompanying drawings wherein like reference numerals identify like elements in which.

DESCRIPTION OF ILLUSTRATED EMBODIMENTS

Figure 1:
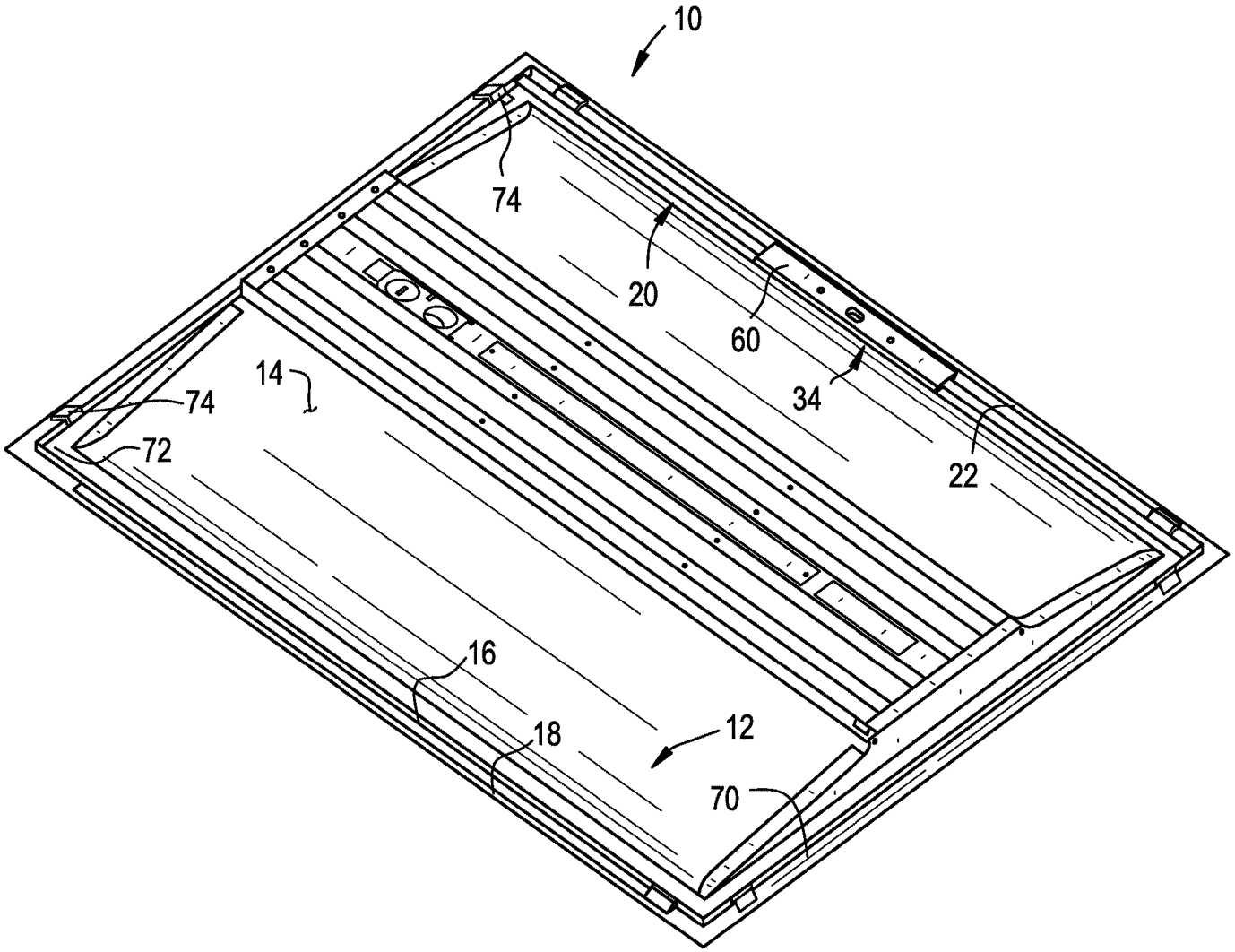
FIG. 1 is a perspective view of a troffer light fixture that is in accordance with an embodiment of the present invention.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

FIG. 1 is a perspective view of a troffer light fixture 10 that is in accordance with an embodiment of the present invention. The troffer light fixture 10 is easy to install, does not require the use of any extra, non-built in brackets to have an acceptable appearance with regard to an existing, previously installed troffer housing, and can be used as a retrofit or as a new installation.

As shown in FIG. 1, the troffer light fixture 10 includes a housing 12. The housing 12 has a back side 14, and the back side 14 of the housing 12 includes a blade 16 on one end 18 and a pair of extendable/retractable arms 20 on the other end 22.

Figure 2:
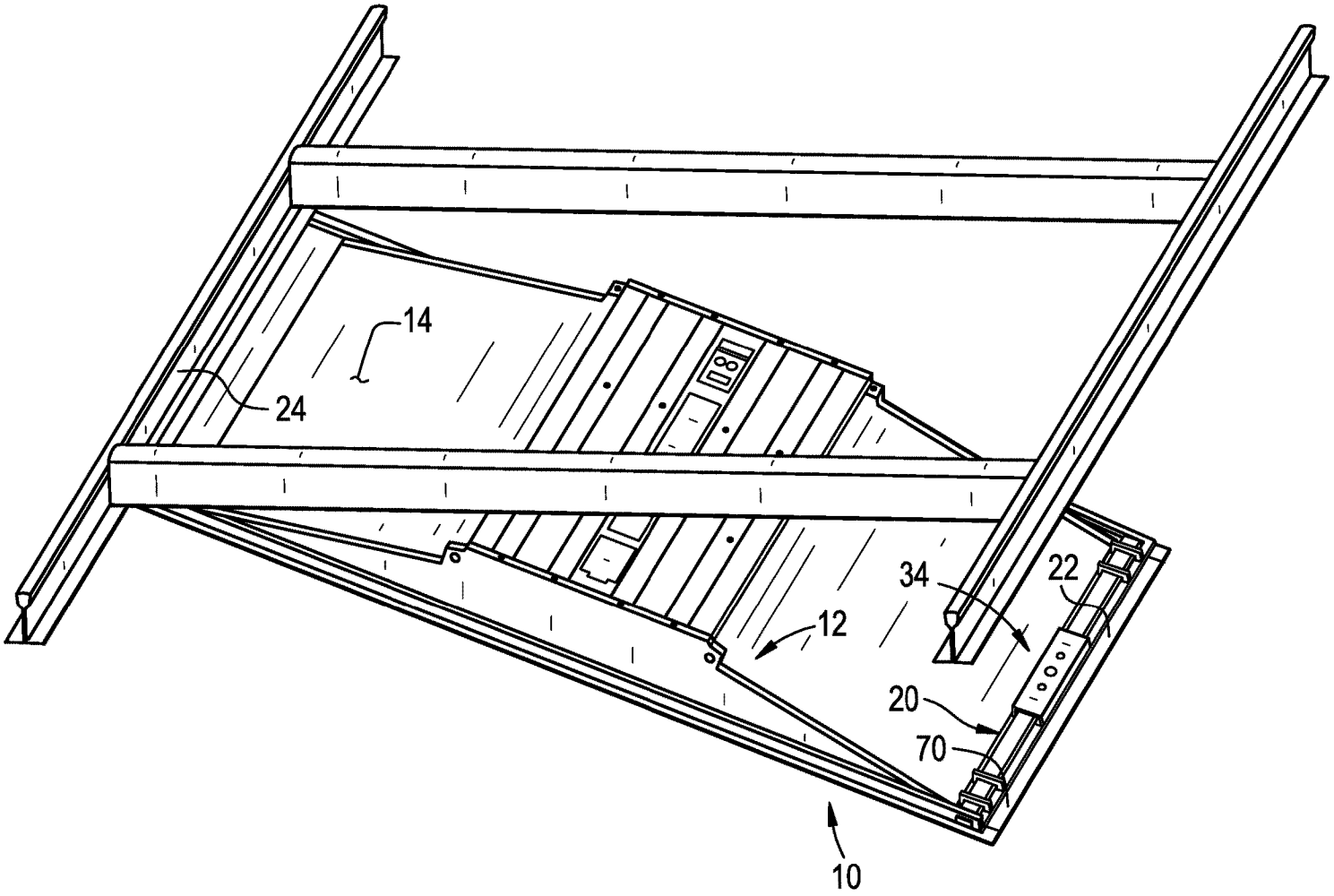
FIGS. 2 and 3 show the troffer light fixture of FIG. 1 being installed vis-a-vis engagement with a T-bar of a dropped ceiling.
Figure 3:
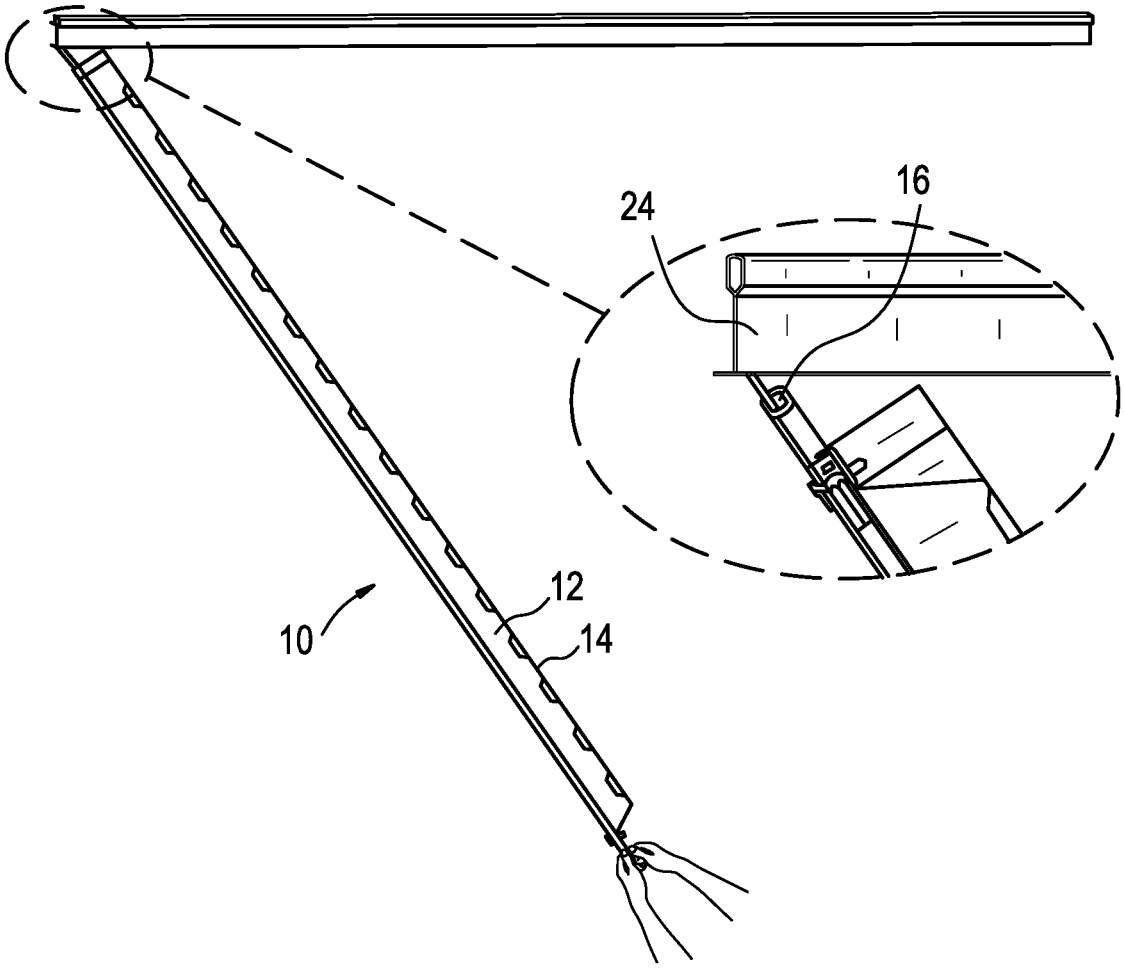
Figure 4:
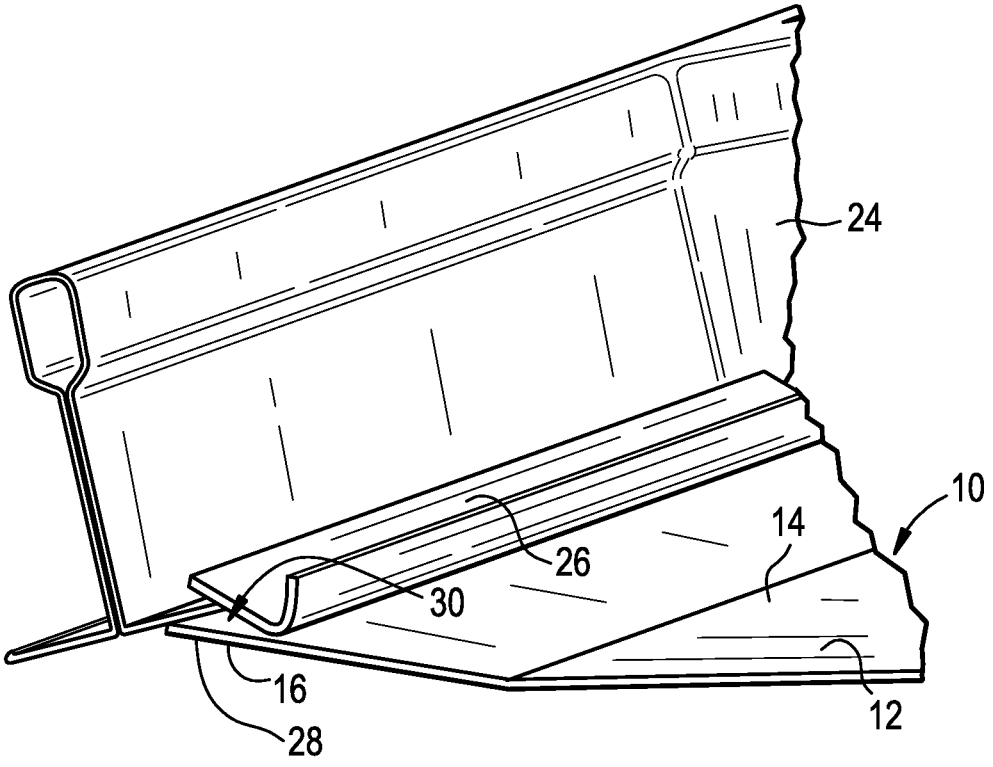
FIG. 4 provides an enlarged view showing a blade of the troffer light fixture pinching the T-bar.
Figure 5:
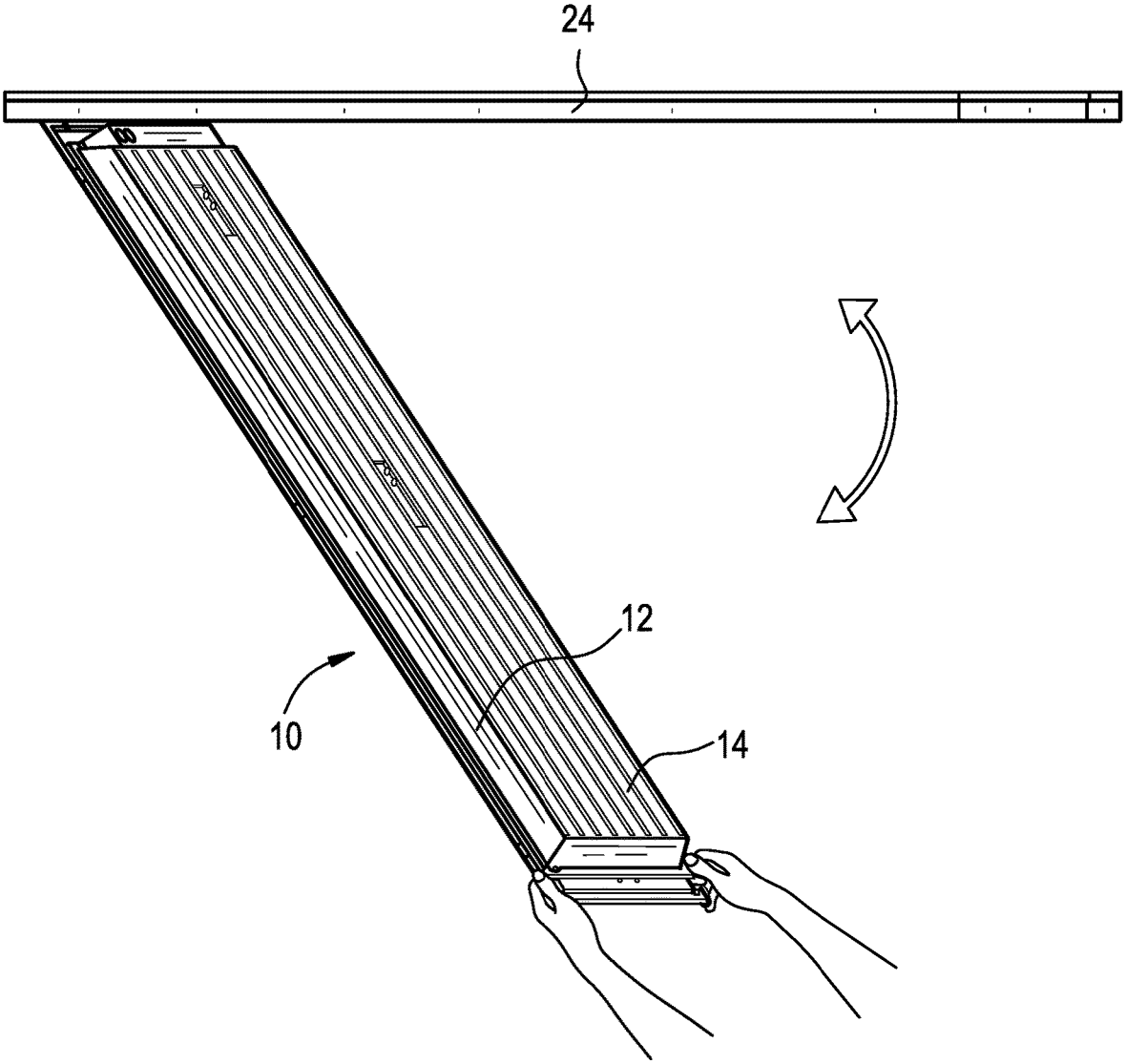
FIG. 5 shows the troffer light fixture being pivoted up toward the ceiling during installation.
Figure 6:
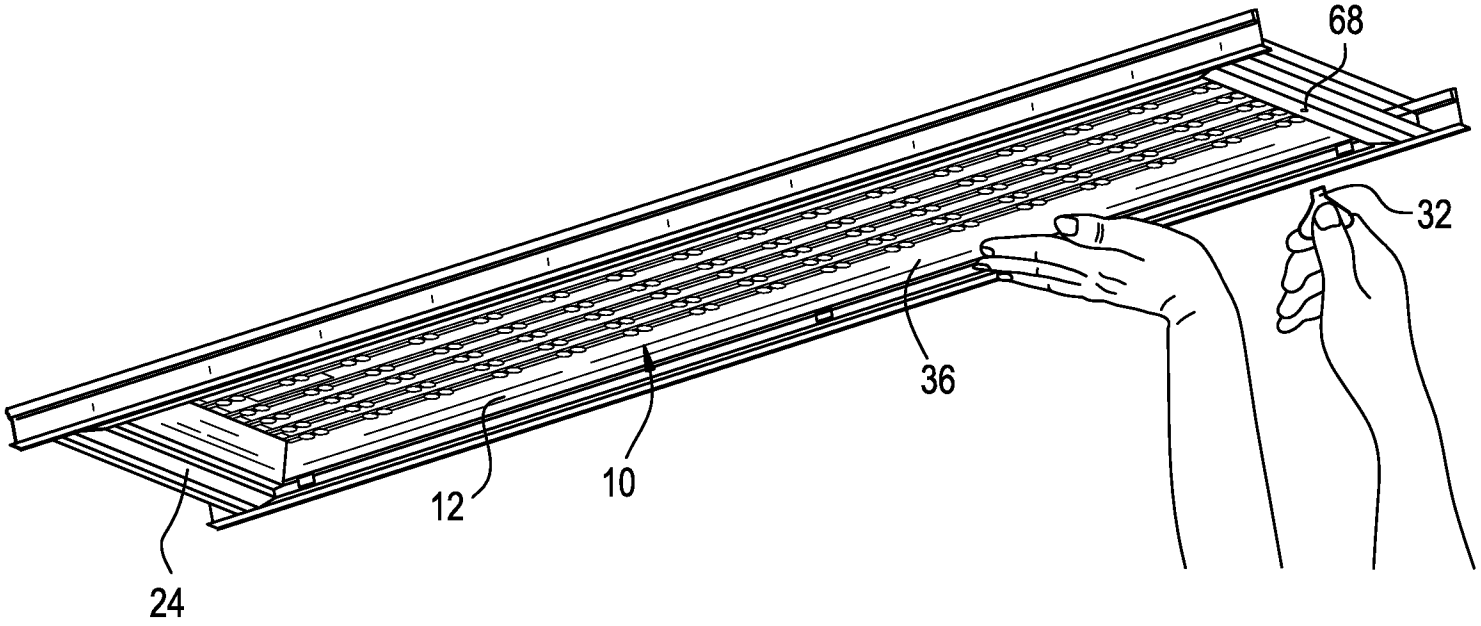
FIG. 6 shows the troffer light fixture being locked in place in the ceiling.

During installation, as shown in FIGS. 2 and 3, the end 18 that has the blade 16 is engaged with a T-bar 24 of a dropped ceiling. As best seen in FIG. 4, the blade 16 is preferably provided in the form of a wall 26 which is spaced apart from a surface 28 of the housing 12 and provides a pinch area 30 which receives the T-bar 24 and pinches it during installation such that the troffer light fixture 10 is frictionally engaged with the T-bar 24. Once the T-bar 24 is pinched by the blade 16, the troffer light fixture 10 can be pivoted upward toward the ceiling, as shown in FIG. 5, until the troffer light fixture 10 is horizontally aligned with the ceiling, as shown in FIG. 6, at which time the troffer light fixture 10 can be locked in place. The troffer light fixture 10 may be configured such that this locking in place is performed using either a key or a screwdriver 32.

Figure 7:
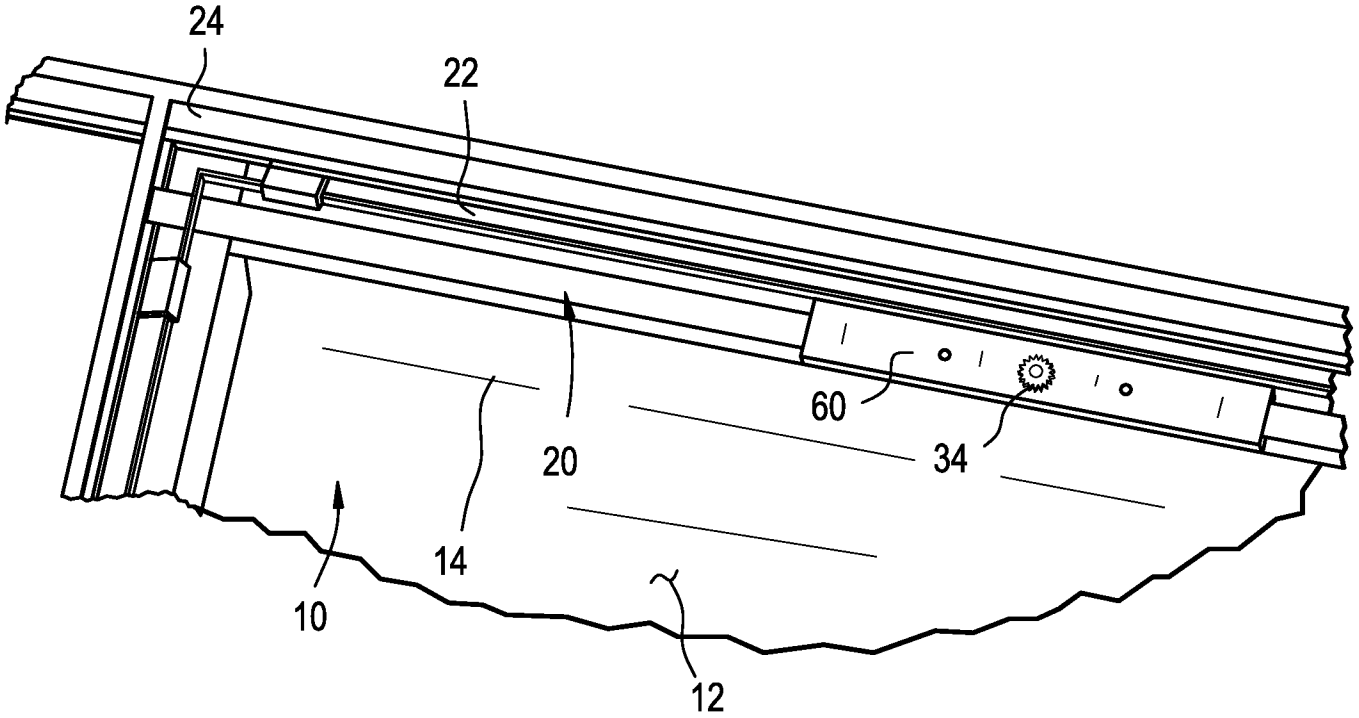
FIGS. 7 and 8 show how extendable arms of the troffer light fixture engage the T-bars of a dropped ceiling causing the troffer light fixture to lock in place in the ceiling.
Figure 8:
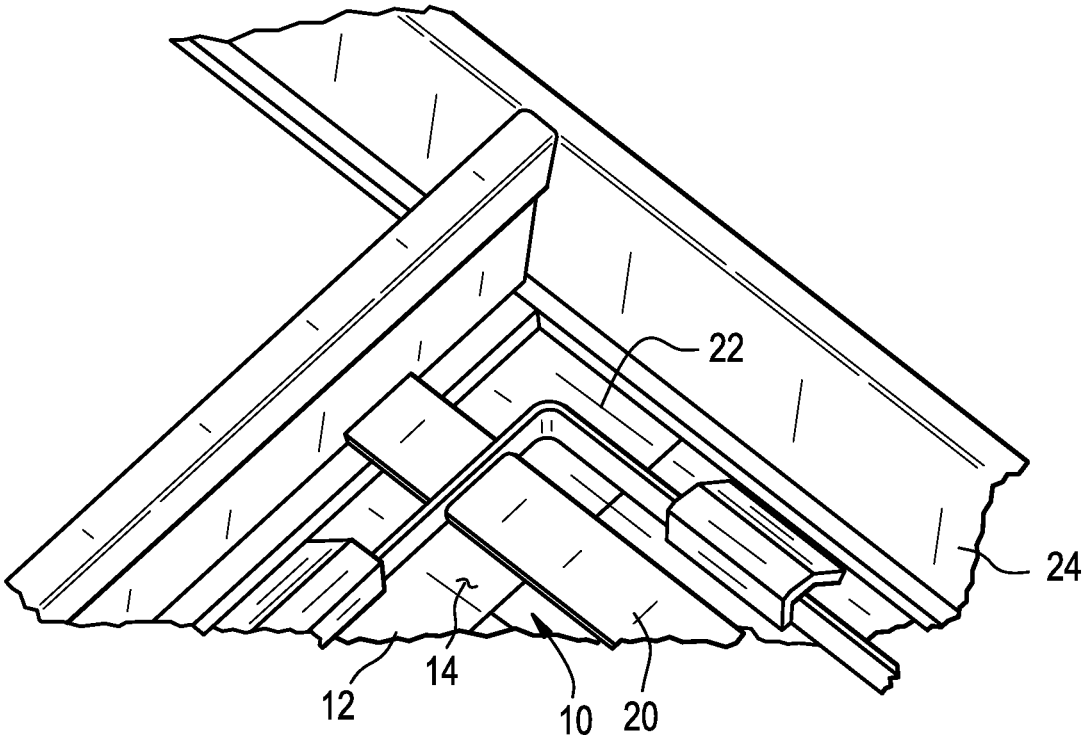
Figure 9:
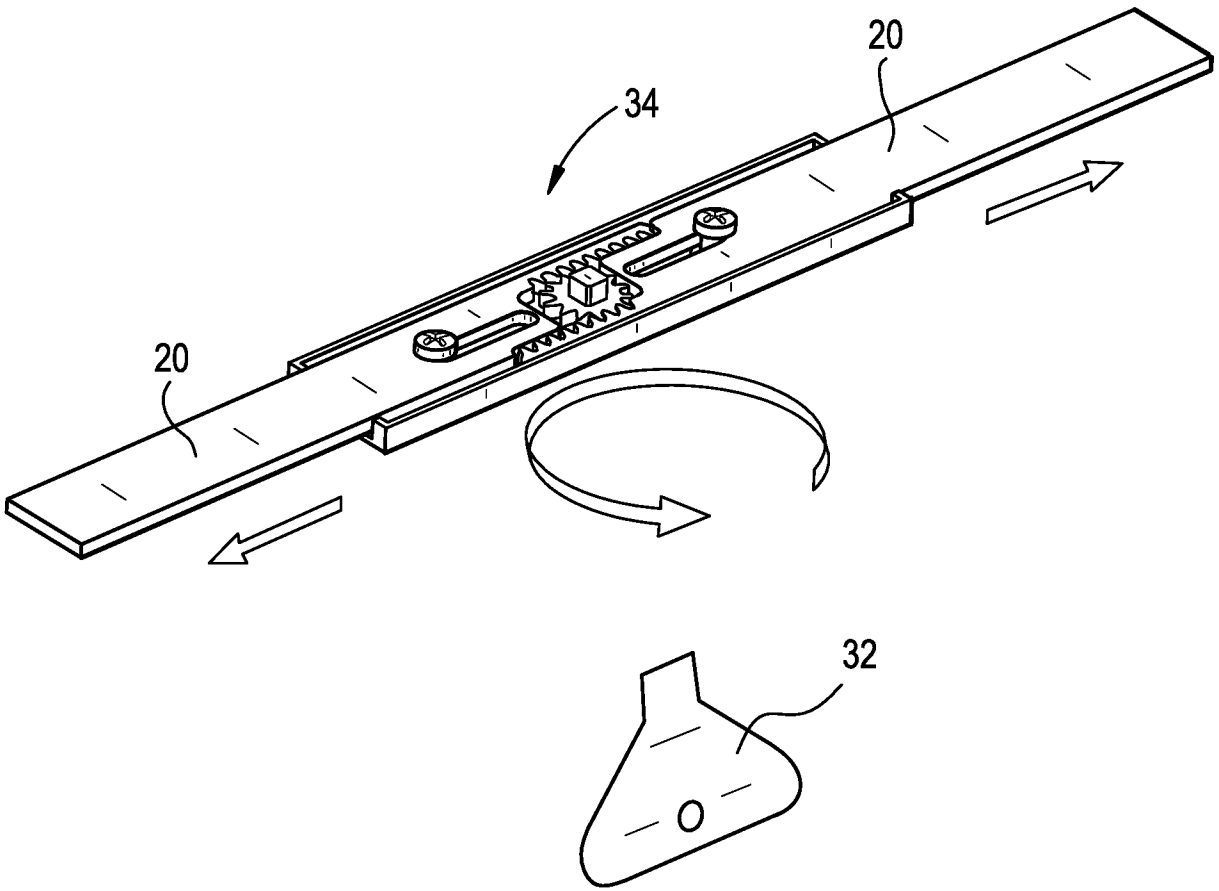
FIG. 9 shows the arms being extended.
Figure 10:
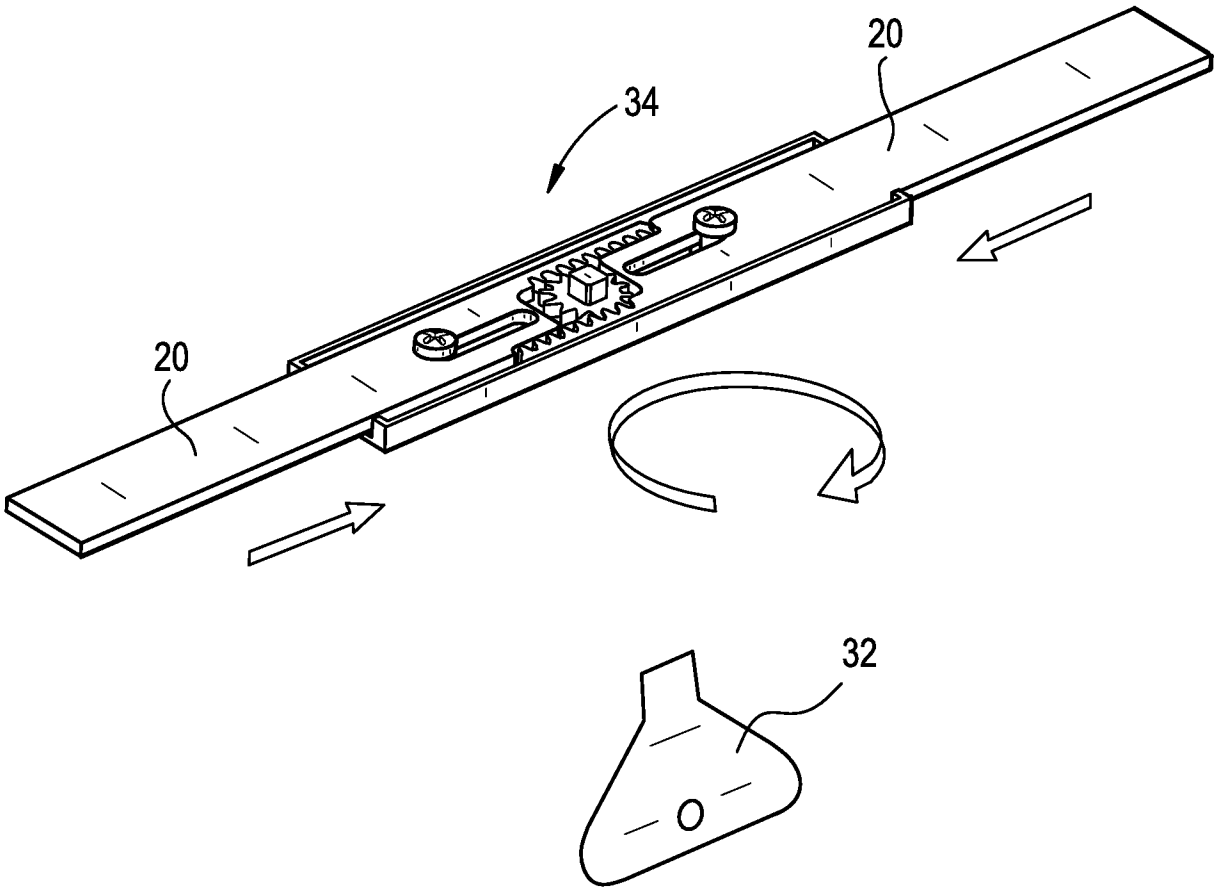
FIG. 10 shows the arms being retracted.

The locking in place occurs through the employment of the extendable/retractable arms 20. As shown in FIGS. 7 and 8, when the arms 20 are extended, they extend over T-bars 24 of the dropped ceiling, thus effectively securing the troffer light fixture 10 in the ceiling. As shown in FIGS. 9 and 10, the arms 20 can either be extended or retracted. To remove the troffer light fixture 10 from the ceiling, the arms 20 are retracted and then the troffer light fixture 10 is pivoted downward for removal, wherein during removal the troffer light fixture 10 is pulled away from the ceiling, causing the T-bar 24 to disengage from the blade 16.

Regarding the arms 20 that are extendable and retractable, preferably a mechanism 34 is provided that is accessible to a user from a front side 36 of the housing 12, as shown in FIG. 6. Preferably, the mechanism 34 provides that the arms 20 extend when the mechanism 34 is rotated in one direction as shown in FIG. 9, and that the arms 20 retract when the mechanism 34 is rotated in the other direction as shown in FIG. 10.

Figure 11:
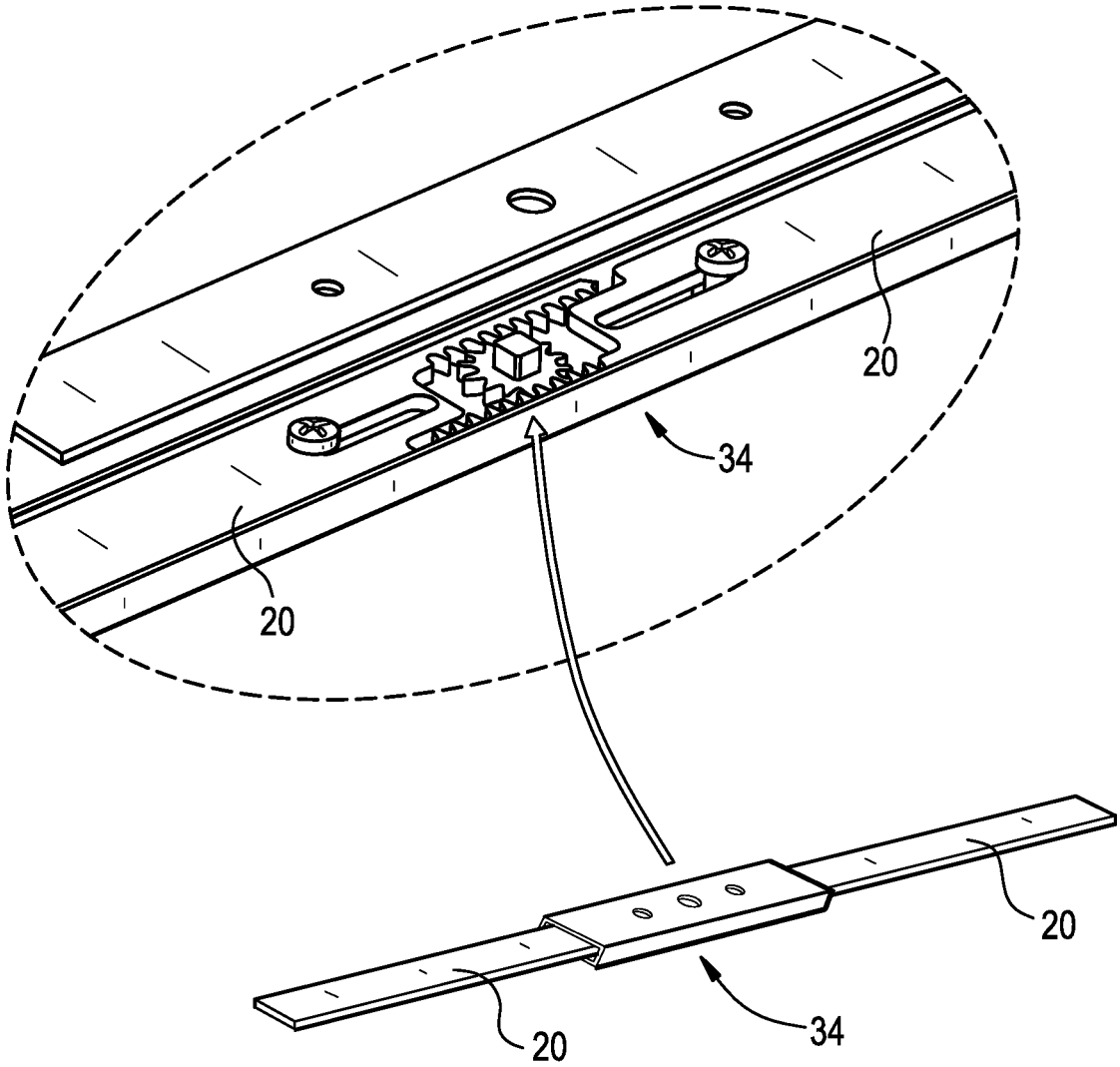
FIG. 11 provides an enlarged view of a mechanism that functions to extend and retract the arms.

The mechanism 34 will be now described with reference to FIGS. 11 and 12. As shown, the mechanism 34 provides that a rotatable member 38 that mates with a gear 40. Specifically, preferably an extension 42 of the rotatable member 38 inserts into a corresponding opening 44 in the center of the gear 40. An outer surface 46 of the gear 40 provides gear teeth 48, and those gear teeth 48 mesh with gear racks 50 that are provided on the arms 20. This meshing provides that rotation of the rotatable member 38 causes the gear racks 50 to ride across the gear teeth 48 on the gear 40, causing the arms 20 to either extend or retract depending on which direction the rotatable member 38 is being rotated.

Each of the arms 20 preferably has a slot 52 formed therein, and preferably a fastener 54 extends through the slot 52. The slots 52 effectively define the range of extension and retraction of the arms. 20. Specifically, when the arms 20 have been extended so much that the ends 56 of the slots 52 have contacted the fasteners 54, the arms 20 cannot be extended any further. Likewise, when the arms 20 have been retracted so much that the other ends 58 of the slots 52 have contacted the fasteners 54, the arms 20 cannot be retracted any further. Preferably, the mechanism 34 is contained in a housing 60 that is formed by two plates 62, 64 that come together and protect the mechanism therein.

As discussed previously, preferably the mechanism 34 is accessible from a front side 36 of the housing 12 as shown in FIG. 6. More specifically, preferably the rotatable member 34 has a surface 66 that is configured to receive either a key or a screwdriver, and that surface 66 is preferably accessible through a hole 68 that is provided in the front side 36 of the housing 12.

While a specific mechanism 34 having a gear 40 and gear racks 50 on the arms 20 have been shown and described, other types of mechanisms for extending/retracting the arms 20 can be employed while still staying well within the scope of the invention.

Additionally, preferably a trim ring 70 is provided on the front side 36 of the housing 12 which works to cover any opening that may otherwise exist between a previously installed troffer housing and the grid 24 of the dropped ceiling. As shown in FIG. 1, the back side 12 of the troffer light fixture 10 may also have an upstanding wall 72, and removable clips 74 may be provided on the upstanding wall 72.

The troffer light fixture 10 may include other components which are conventional and therefore not specifically shown, such as wiring and one or more LED light strips. The troffer light fixture 10 can also be provided in many styles, such as volumetric or flat panel.

To install the troffer light fixture 10 in a ceiling, the end 18 of the troffer light fixture 10 is engaged with the T-bar 24 of a dropped ceiling such that the T-bar 24 gets pinched by the blade 16 (see FIGS. 2-4). Then, the troffer light fixture 10 is pivoted up toward the ceiling (see FIG. 5). Once the troffer light fixture 10 has been pivoted all the way up to the ceiling, the troffer light fixture can be locked in place (see FIG. 6).

To remove the troffer light fixture 10 from the ceiling, the troffer light fixture 10 is unlocked (via the key or screwdriver 32), the troffer light fixture 10 is pivoted down away from the ceiling, and then the end 18 of the troffer light fixture 10 is disengaged from the T-bar 24 of the dropped ceiling, and the troffer light fixture 10 is removed.

The troffer light fixture 10 provides many advantages. For example, it is easy to install. It also does not require the use of any extra, non-built in brackets to have an acceptable appearance, and can be used as a retrofit or as a new installation.

Figure 13:
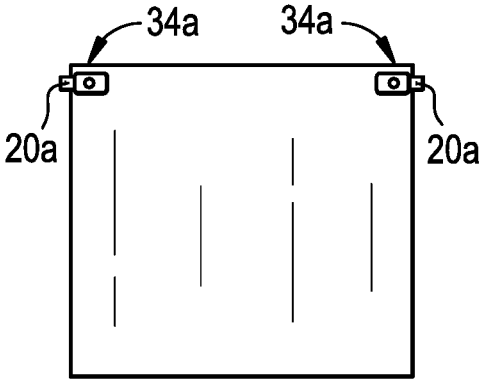
FIGS. 13-15 show alternative embodiments, specifically with regard to different ways to provide extendable/retractable arms.
Figure 14:
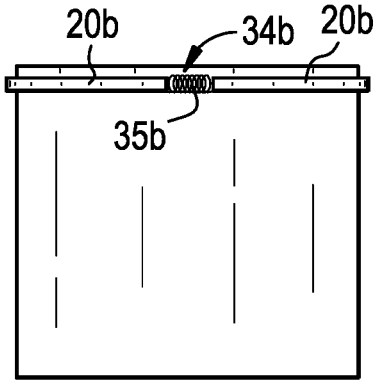
Figure 15:
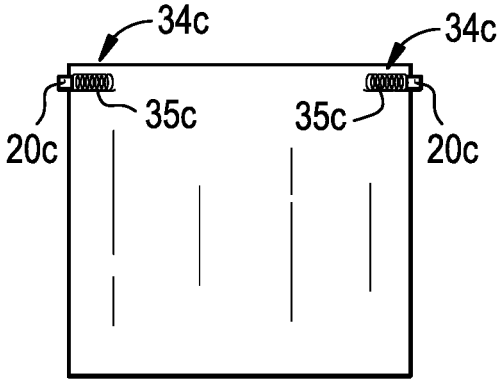

FIGS. 13-15 show alternative embodiments, specifically with regard to different ways to provide extendable/retractable arms. Specifically, FIG. 13 shows an embodiment where two twisting mechanisms 34*a* are located towards the outward corners, wherein each mechanism 34*a* expands a much shorter length than the version shown in FIG. 9. As such, much shorter arms 20*a* can be used. FIG. 14 shows an embodiment where the twisting mechanism 34*b* employs a simple spring 35*b* that pushes the fingers 20*b* outwards. FIG. 15 an embodiment that is very similar to that which is shown in FIG. 14, but where two separate mechanisms 34*c* (employing springs 35*c*) are provided—one at each end—thereby allowing for the use of much shorter arms 20*c*.

Figure 16:
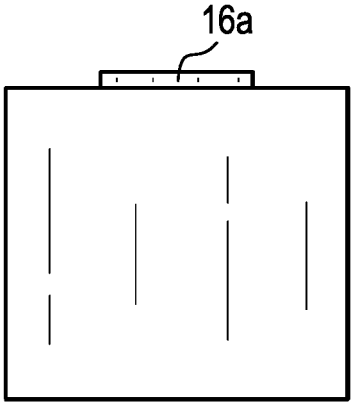
FIGS. 16-17 show alternative embodiments, specifically with regard to different ways to provide one or more blades for pinching the T-bar.
Figure 17:
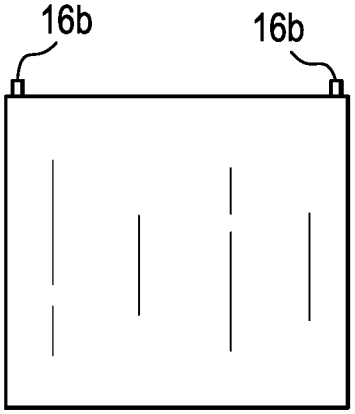

FIGS. 16-17 show alternative embodiments, specifically with regard to different ways to provide one or more blades for pinching the T-bar. Specifically, FIG. 16 shows the case where a shorter blade 16*a* is utilized, and FIG. 17 shows the case where multiple blades 16*b* are employed. In the specific example shown in FIG. 17, a relatively short blade is provided at each end.

Figure 18:
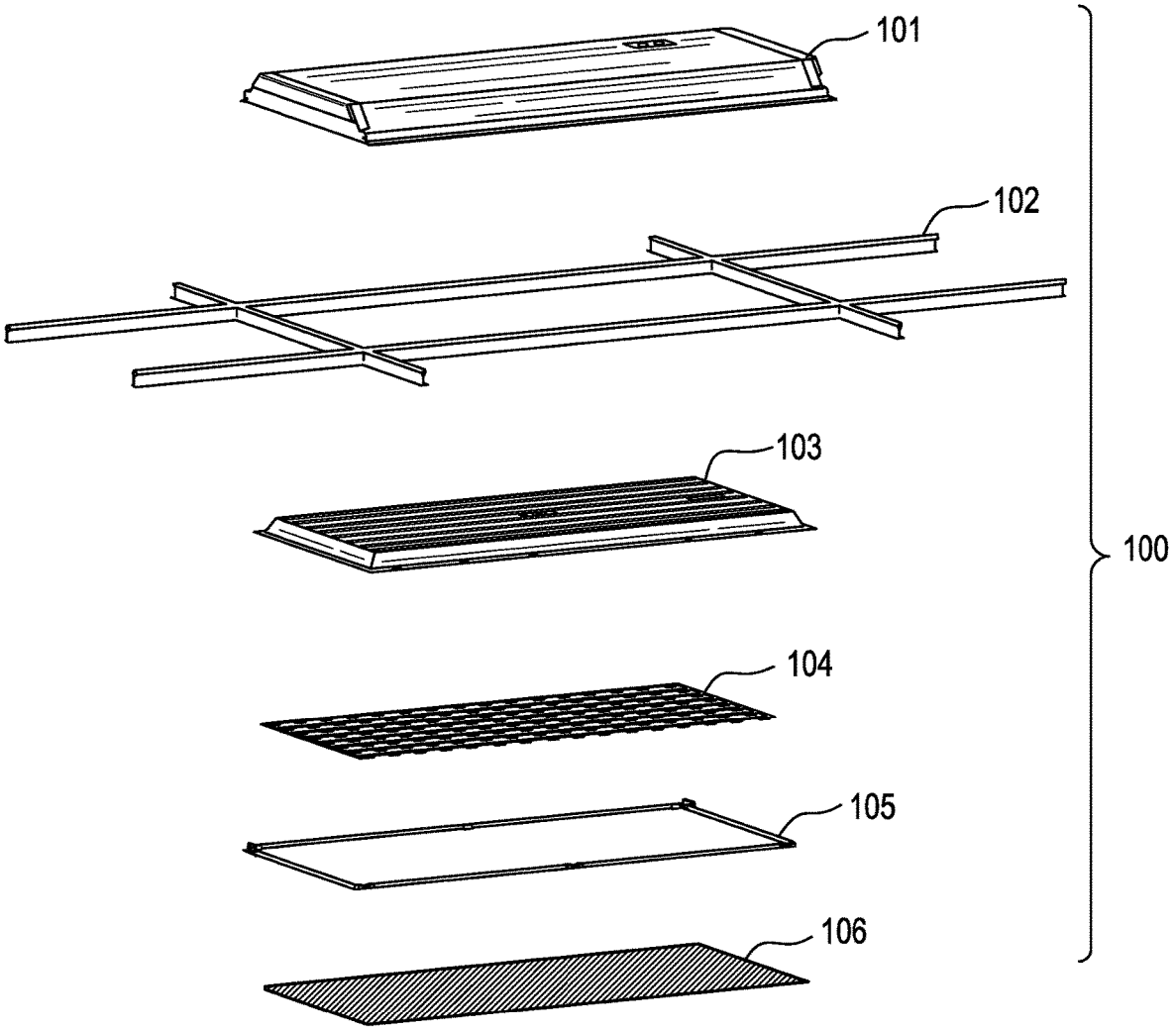
FIG. 18 is an exploded view of a flat panel style LED fixture/retrofit kit which can incorporate a troffer light fixture that is in accordance with the present invention.
Figure 19:
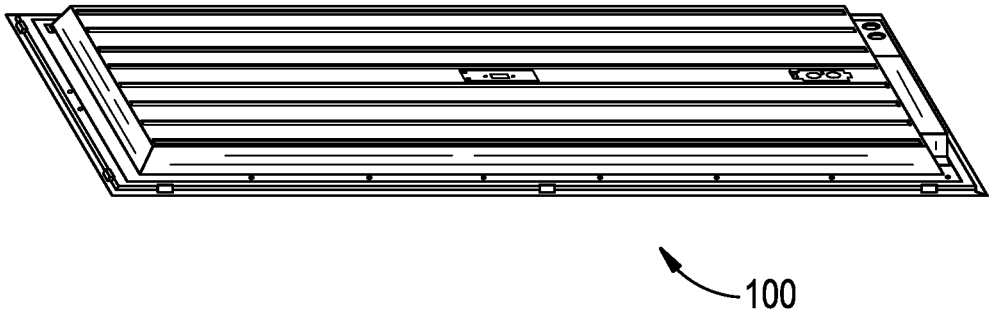
FIG. 19 is a perspective view of the flat panel style LED fixture/retrofit kit shown in FIG. 18.

FIG. 18 is an exploded view of a flat panel style LED fixture/retrofit kit 100 which can incorporate a troffer light fixture that is in accordance with the present invention, wherein reference numeral 101 identifies the old existing fluorescent housing, reference numeral 102 identifies the existing T-bar grid, reference numeral 103 identifies the back housing, reference numeral 104 identifies the LED circuit boards and optical lenses, and reference numeral 105 identifies a metal frame that locks a plastic diffuser lens 106 unto the back housing 103. FIG. 19 is a perspective view of the flat panel style LED fixture/retrofit kit 100 shown in FIG. 18.

Figure 21:
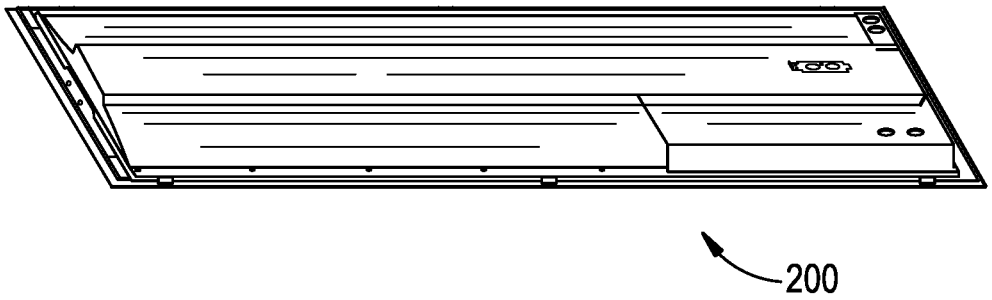
FIG. 21 is a perspective view of the volumetric style LED fixture/retrofit kit shown in FIG. 22.
Figure 20:
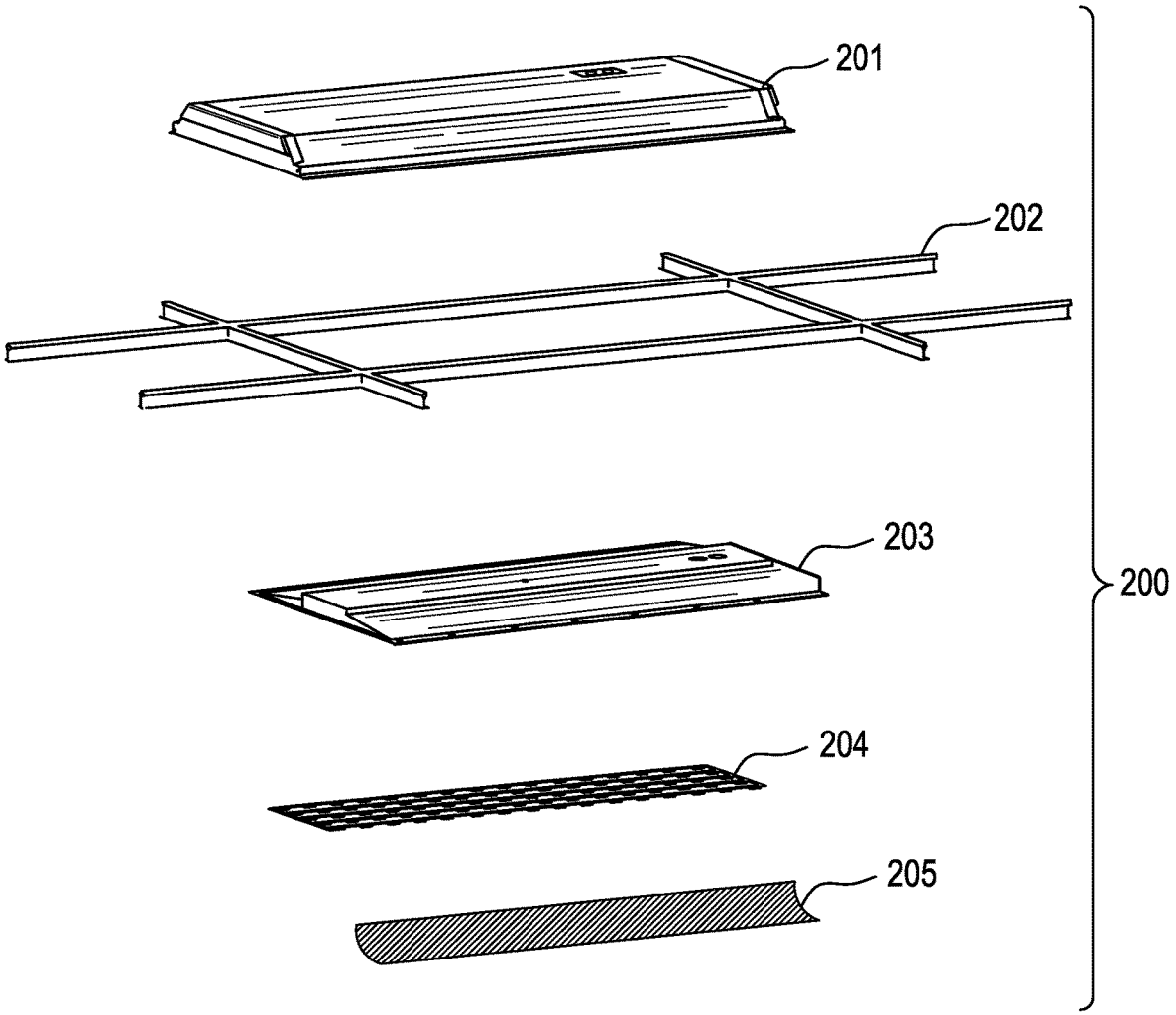
FIG. 20 is an exploded view of a volumetric style LED fixture/retrofit kit which can incorporate a troffer light fixture that is in accordance with the present invention.

FIG. 20 is an exploded view of a volumetric style LED fixture/retrofit kit 200 which can incorporate a troffer light fixture that is in accordance with the present invention, wherein reference numeral 101 identifies the old existing fluorescent housing, reference numeral 102 identifies the existing T-bar grid, reference numeral 103 identifies the back housing, reference numeral 104 identifies the LED circuit boards, and reference numeral 105 identifies a plastic diffuser lens that gets clipped into the back housing 103 covering the LED circuit board 104. FIG. 21 is a perspective view of the volumetric style LED fixture/retrofit kit 200 shown in FIG. 20.

Figure 22:
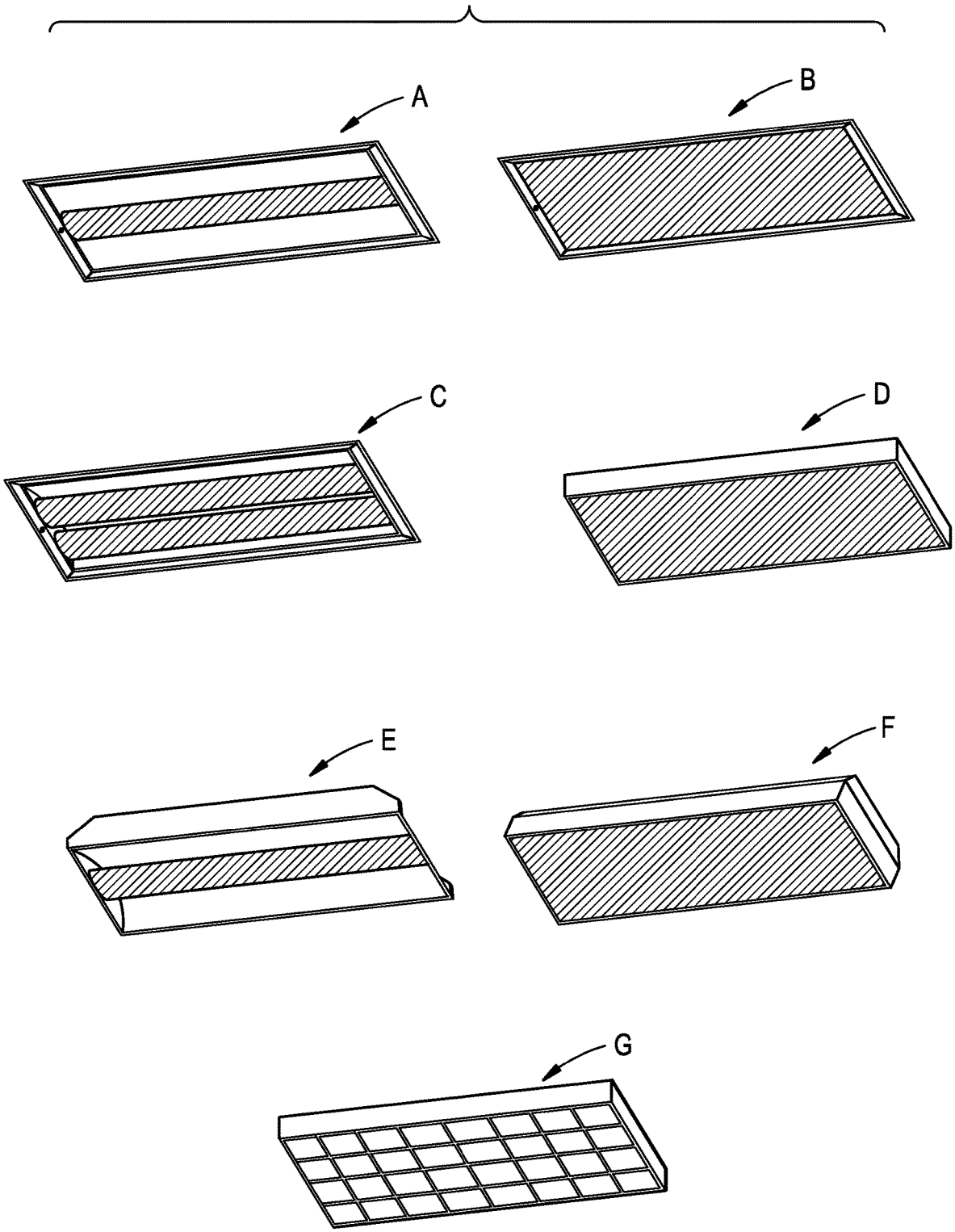
FIG. 22 shows examples of existing fluorescent fixture housings and components that would be removed or reutilized to incorporate a troffer light fixture that is in accordance with the present invention.

FIG. 22 shows examples of existing fluorescent fixture housings and components that would be removed or reutilized during the installation process to incorporate a troffer light fixture that is in accordance with the present invention. Specifically, A identifies a single basket volumetric style door that would be installed inside of a volumetric troffer fixture E. That volumetric style door A would be removed and disposed of to make room for a troffer light fixture that is in accordance with the present invention. C shows a double basket volumetric style door that would be installed inside of a volumetric troffer fixture E. That volumetric style door C would be removed and disposed of to make room for a troffer light fixture that is in accordance with the present invention. B shows a prismatic lens style door that would be installed inside of a troffer fixture D or F. That prismatic style door B would be removed and disposed of to make room for a troffer light fixture that is in accordance with the present invention. G shows a parabolic style door that would be installed inside of a troffer fixture D or F. That prismatic style door G would be removed and disposed of to make room for a troffer light fixture that is in accordance with the present invention.

Figure 12:
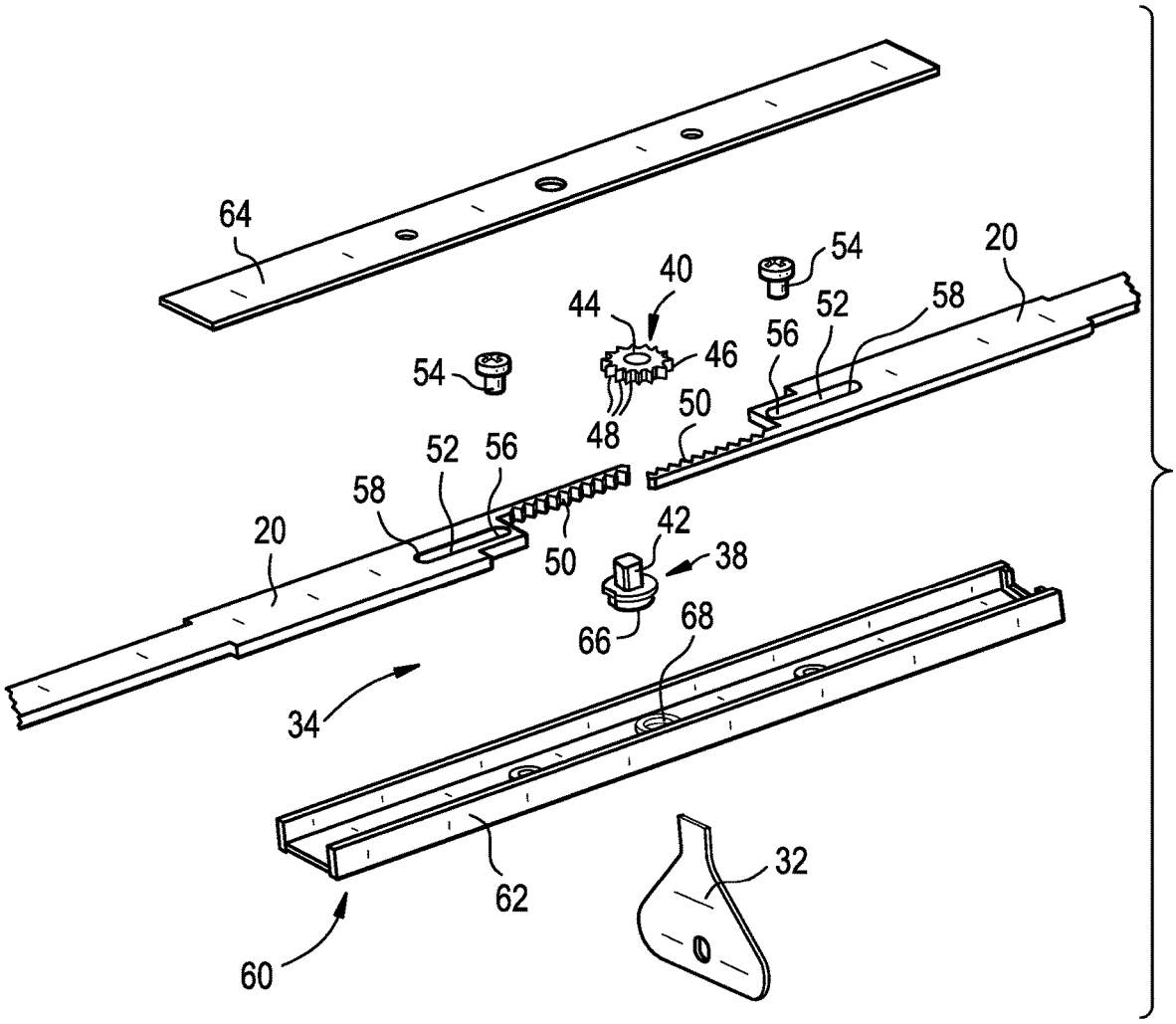
FIG. 12 is an exploded view of the mechanism shown in FIG. 11.

With regard to the alternative embodiments shown in FIGS. 13-15 (i.e., regarding different ways to provide extendable/retractable arms), the mechanisms 34*a* shown in FIG. 13 can be provided by basically providing what is shown in FIG. 12, but omitting one of the arms and making the housing shorter.

Figure 23:
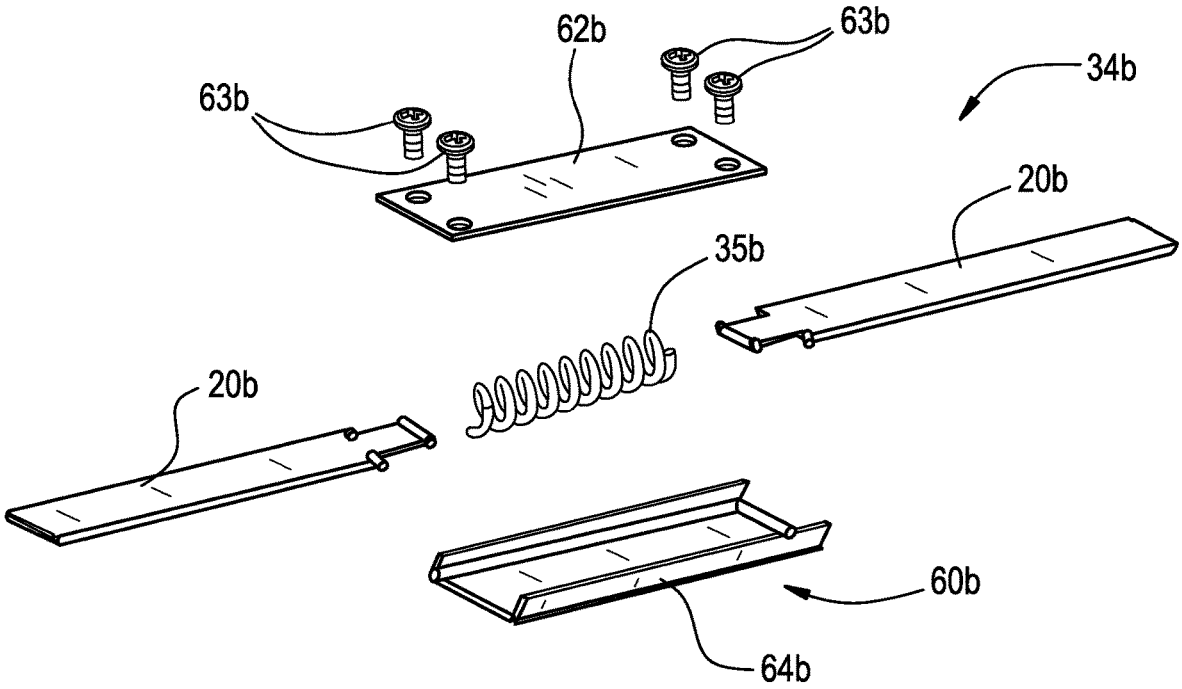
FIG. 23 is an exploded view of a spring mechanism relating to FIG. 14.
Figure 24:
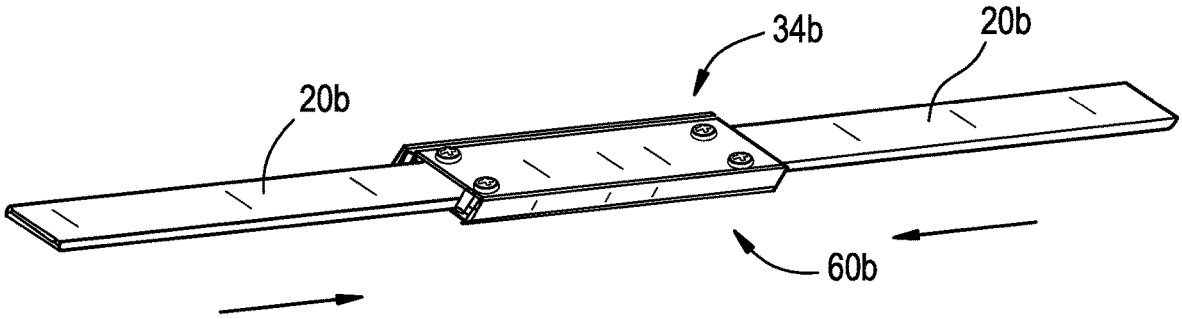
FIG. 24 is a perspective a view of the spring mechanism shown in FIG. 23, showing the arms retracted.
Figure 25:
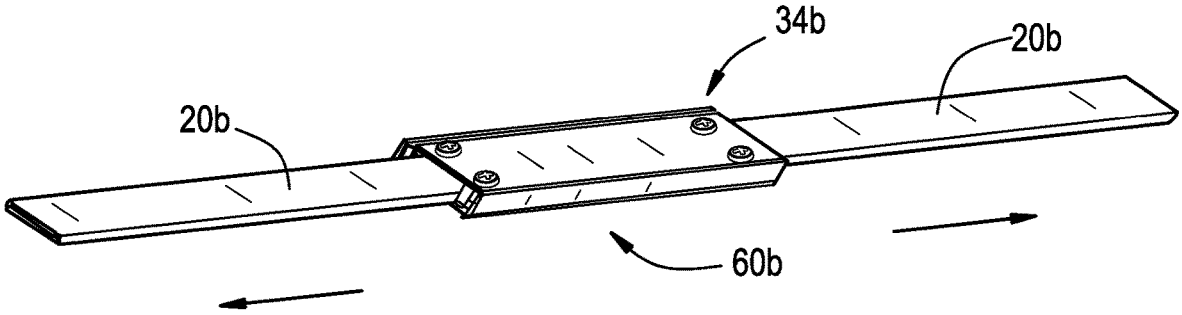
FIG. 25 is a perspective a view of the spring mechanism shown in FIG. 23, showing the arms extended.

The mechanism 34*b* shown in FIG. 14 can be provided by providing what is shown in FIGS. 23-25, wherein FIG. 23 is an exploded view of the spring mechanism 34*b* relating to FIG. 14 and showing the internal spring 35*b*, while FIG. 24 is a perspective view of the spring mechanism 34*b* showing the arms 20*b* retracted (i.e., by operation of a user pushing on the arms 20*b*), and FIG. 25 is a perspective view of the spring mechanism 34*b*, showing the arms 20*b* extended (i.e., by operation of the spring 35*b* pushing on the arms 20*b*). As shown, a housing 60*b* may be provided that is formed by two plates 62*b*, 64*b* (using fasteners 63*b* (and possibly also corresponding nuts (not shown))) that come together and protect the spring 35*b*.

Figure 26:
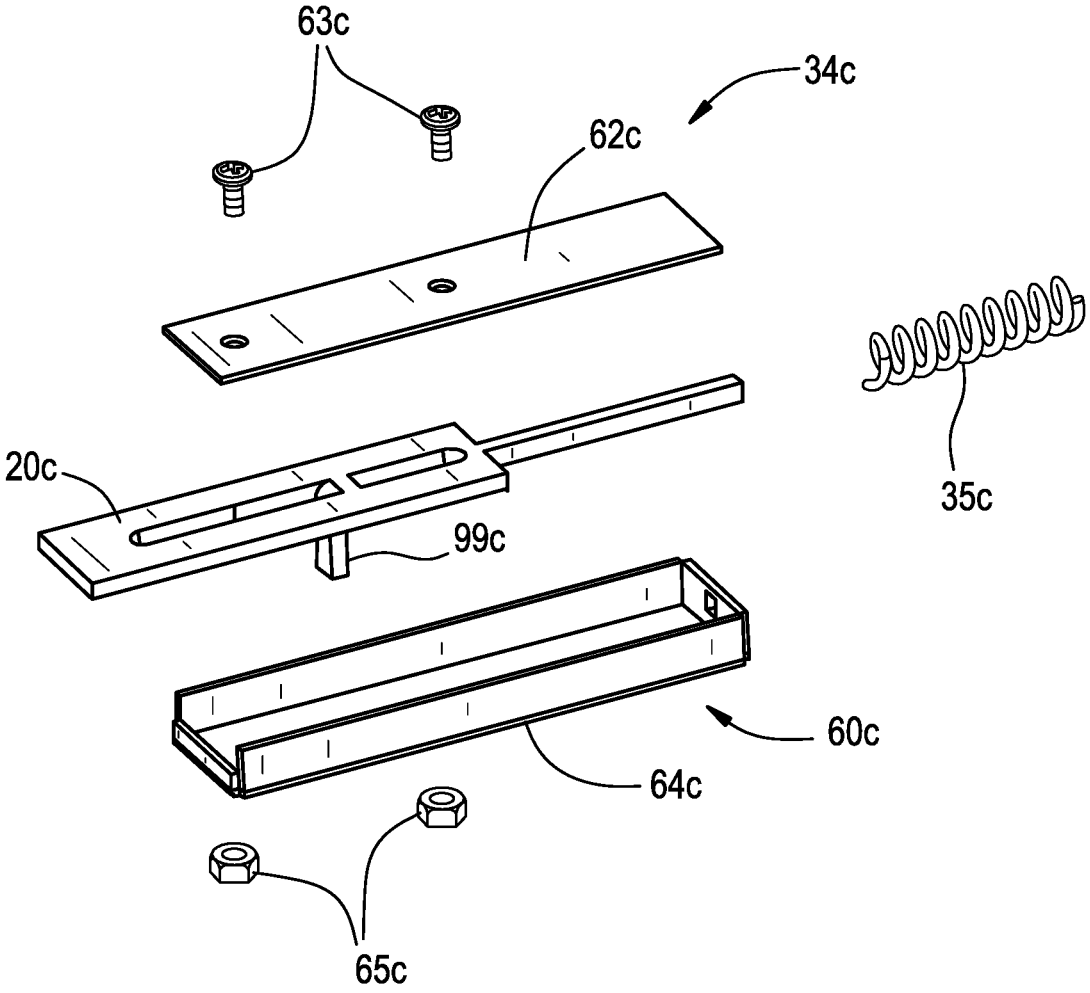
FIG. 26 is an exploded view of a spring mechanism relating to FIG. 15.
Figure 27:
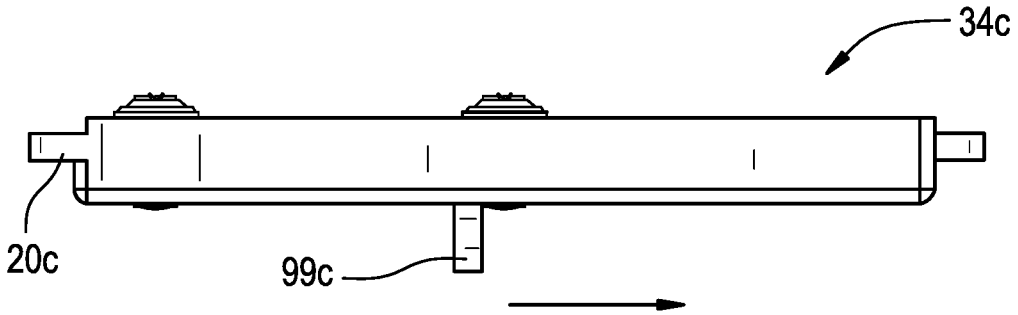
FIG. 27 is a side view of the spring mechanism shown in FIG. 26, showing the arms retracted.
Figure 28:
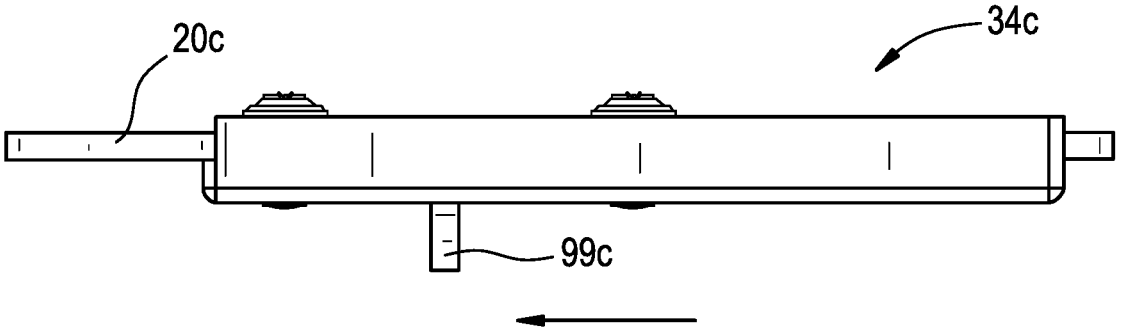
FIG. 28 is a side view of the spring mechanism shown in FIG. 26, showing the arms extended.

The mechanisms 34*c* shown in FIG. 15 can be provided by providing what is shown in FIGS. 26-28, wherein FIG. 26 is an exploded view of one of the spring mechanisms 34*c* relating to FIG. 15 (the other would just be a mirror image), while FIG. 27 is a perspective view of the spring mechanism 34*c* showing the arm 20*c* retracted, and FIG. 28 is a perspective view showing the arms 20*c* extended. As shown, preferably each mechanism 34*c* is provided with a lever 99*c* which is pushable by a user to retract the arms 20*c*, and when the lever 99*c* is released, the spring 35*c* takes over to extend the arms 20*c*. As shown, a housing 60*c* may be provided that is formed by two plates 62*c*, 64*c* (using fasteners 63*c* and corresponding nuts 65*c*) that come together and protect the spring 35*c*.

Many other embodiments are entirely possible. For example, either one of the mechanisms 34 or 34*a* can be configured to provide an additional, smaller arm or finger, which when the mechanism 34 or 34*a* is twisted, it pushes up 90 degrees from the other arms 20 (or arm 20*a*). The benefit to these alternative embodiments is they have more rigidity holding the retrofit in place due to more touch points.

While specific embodiments of the invention have been shown and described, it is envisioned that those skilled in the art may devise various modifications without departing from the spirit and scope of the present invention.

What is claimed is:

1. A troffer light fixture for installation relative to a T-bar of a dropped ceiling, said troffer light fixture comprising: a housing having a back side; a blade on the back side of the housing configured to pinch the T-bar of the dropped ceiling; arms on the back side of the housing which are configured to extend and engage the T-bar of the dropped ceiling, a mechanism which comprises a gear, and a rotatable member mates with the gear.

2. A troffer light fixture as recited in claim 1, wherein the housing has a front side, wherein the arms are extendable and retractable via user-interaction with the mechanism that is accessible from the front side of the housing.

3. A troffer light fixture as recited in claim 1, wherein the mechanism is configured such that a user interacts with the mechanism to extend and retract the arms.

4. A troffer light fixture as recited in claim 3, wherein the mechanism is configured to be engaged with at least one of a key and a screwdriver.

5. A troffer light fixture as recited in claim 3, wherein the mechanism comprises a pair of mechanisms.

6. A troffer light fixture as recited in claim 1, wherein the mechanism is configured such that the arms extend when the mechanism is rotated in one direction, and the arms retract when the mechanism is rotated in another direction.

7. A troffer light fixture as recited in claim 1, wherein the gear comprises an opening, the rotatable member comprises an extension, and the extension inserts into opening in the gear.

8. A troffer light fixture as recited in claim 7, wherein the arms comprise gear racks, wherein the gear comprises an outer surface which provides gear teeth, wherein the gear teeth mesh with the gear racks that are provided on the arms, wherein the mesh provides that rotation of the rotatable member causes the gear racks to ride across the gear teeth on the gear, causing the arms to either extend or retract depending on which direction the rotatable member is rotated.

9. A troffer light fixture as recited in claim 8, wherein the arms have slots formed therein, wherein fasteners extend through the slots, and wherein the slots define a range of extension and retraction of the arms.

10. A troffer light fixture as recited in claim 1, wherein the blade comprises a wall which is spaced apart from a surface of the housing, and provides a pinch area which receives the T-bar and pinches the T-bar during installation such that the troffer light fixture is frictionally engaged with the T-bar.

11. A troffer light fixture as recited in claim 1, wherein said blade on the back side of the housing comprises a plurality of blades.

12. A troffer light fixture as recited in claim 1, wherein the housing has a front side, wherein a trim ring is provided on the front side of the housing and the trim ring is configured to cover any opening that may otherwise exist between a previously installed troffer housing and a grid of the dropped ceiling.

13. A troffer light fixture for installation relative to a T-bar of a dropped ceiling, said troffer light fixture comprising: a housing having a back side; arms on the back side of the housing which are configured to extend and engage the T-bar of the dropped ceiling; a mechanism which comprises a gear, and a rotatable member mates with the gear.

14. A troffer light fixture as recited in claim 13, wherein the housing has a front side, wherein the arms are extendable and retractable via user-interaction with the mechanism that is accessible from the front side of the housing.

15. A troffer light fixture as recited in claim 13, wherein the mechanism is configured such that a user interacts with the mechanism to extend and retract the arms.

16. A troffer light fixture as recited in claim 15, wherein the mechanism is configured to be engaged with at least one of a key and a screwdriver.

17. A troffer light fixture as recited in claim 15, wherein the mechanism comprises a pair of mechanisms.

18. A troffer light fixture as recited in claim 13, wherein the mechanism is configured such that the arms extend when the mechanism is rotated in one direction, and the arms retract when the mechanism is rotated in another direction.

19. A troffer light fixture as recited in claim 13, wherein the gear comprises an opening, the rotatable member comprises an extension, and the extension inserts into opening in the gear.

20. A troffer light fixture as recited in claim 19, wherein the arms comprise gear racks, wherein the gear comprises an outer surface which provides gear teeth, wherein the gear teeth mesh with the gear racks that are provided on the arms, wherein the mesh provides that rotation of the rotatable member causes the gear racks to ride across the gear teeth on the gear, causing the arms to either extend or retract depending on which direction the rotatable member is rotated.

21. A troffer light fixture as recited in claim 20, wherein the arms have slots formed therein, wherein fasteners extend through the slots, and wherein the slots define a range of extension and retraction of the arms.

22. A troffer light fixture as recited in claim 13, further comprising a blade which comprises a wall which is spaced apart from a surface of the housing, and provides a pinch area which receives the T-bar and pinches the T-bar during installation such that the troffer light fixture is frictionally engaged with the T-bar.

23. A troffer light fixture as recited in claim 22, wherein said blade comprises a plurality of blades.

24. A troffer light fixture as recited in claim 13, wherein the housing has a front side, wherein a trim ring is provided on the front side of the housing and the trim ring is configured to cover any opening that may otherwise exist between a previously installed troffer housing and a grid of the dropped ceiling.

25. A troffer light fixture for installation relative to a T-bar of a dropped ceiling, said troffer light fixture comprising: a housing having a back side and an edge; and a blade on the back side of the housing configured to pinch the T-bar of the dropped ceiling into contact against the back side of the housing, wherein the blade is engaged with the back side of the housing and is spaced-away from the back side of the housing, wherein space between the blade and the back side of the housing increases as the blade extends from the back side of the housing toward the edge of the housing.

26. A troffer light fixture as recited in claim 25, further comprising arms on the back side of the housing which are configured to extend and engage the T-bar of the dropped ceiling.

27. A troffer light fixture as recited in claim 26, wherein the housing has a front side, wherein the arms are extendable and retractable via user-interaction with a mechanism that is accessible from the front side of the housing.

28. A troffer light fixture as recited in claim 27, wherein the mechanism is configured such that a user interacts with the mechanism to extend and retract the arms.

29. A troffer light fixture as recited in claim 28, wherein the mechanism is configured to be engaged with at least one of a key and a screwdriver.

30. A troffer light fixture as recited in claim 27, wherein the mechanism comprises a pair of mechanisms.

31. A troffer light fixture as recited in claim 27, wherein the mechanism comprises a spring mechanism.

32. A troffer light fixture as recited in claim 27, wherein the mechanism comprises a pair of spring mechanisms.

33. A troffer light fixture as recited in claim 27, wherein the mechanism is configured such that the arms extend when the mechanism is rotated in one direction, and the arms retract when the mechanism is rotated in another direction.

34. A troffer light fixture as recited in claim 27, wherein the mechanism comprises a gear, and a rotatable member mates with the gear.

35. A troffer light fixture as recited in claim 27, wherein the gear comprises an opening, the rotatable member comprises an extension, and the extension inserts into opening in the gear.

36. A troffer light fixture as recited in claim 35, wherein the arms comprise gear racks, wherein the gear comprises an outer surface which provides gear teeth, wherein the gear teeth mesh with the gear racks that are provided on the arms, wherein the mesh provides that rotation of the rotatable member causes the gear racks to ride across the gear teeth on the gear, causing the arms to either extend or retract depending on which direction the rotatable member is rotated.

37. A troffer light fixture as recited in claim 36, wherein the arms have slots formed therein, wherein fasteners extend through the slots, and wherein the slots define a range of extension and retraction of the arms.

38. A troffer light fixture as recited in claim 25, wherein the blade provides a pinch area which receives the T-bar and pinches the T-bar against the back side of the housing during installation such that the troffer light fixture is frictionally engaged with the T-bar.

39. A troffer light fixture as recited in claim 25, wherein said blade on the back side of the housing comprises a plurality of blades.

40. A troffer light fixture as recited in claim 25, wherein the housing has a front side, wherein a trim ring is provided on the front side of the housing and the trim ring is configured to cover any opening that may otherwise exist between a previously installed troffer housing and a grid of the dropped ceiling.

41. A troffer light fixture for installation relative to a T-bar of a dropped ceiling, said troffer light fixture comprising: a housing having a back side; and a blade on the back side of the housing configured to pinch the T-bar of the dropped ceiling into contact against the back side of the housing, further comprising arms on the back side of the housing which are configured to extend and engage the T-bar of the dropped ceiling, wherein the housing has a front side, wherein the arms are extendable and retractable via user-interaction with a mechanism that is accessible from the front side of the housing, wherein the mechanism comprises a gear, and a rotatable member mates with the gear.

42. A troffer light fixture as recited in claim 41, wherein the mechanism is configured such that a user interacts with the mechanism to extend and retract the arms.

43. A troffer light fixture as recited in claim 42, wherein the mechanism is configured to be engaged with at least one of a key and a screwdriver.

44. A troffer light fixture as recited in claim 41, wherein the mechanism comprises a pair of mechanisms.

45. A troffer light fixture as recited in claim 41, wherein the mechanism comprises a spring mechanism.

46. A troffer light fixture as recited in claim 41, wherein the mechanism comprises a pair of spring mechanisms.

47. A troffer light fixture as recited in claim 41, wherein the mechanism is configured such that the arms extend when the mechanism is rotated in one direction, and the arms retract when the mechanism is rotated in another direction.

48. A troffer light fixture as recited in claim 41, wherein the gear comprises an opening, the rotatable member comprises an extension, and the extension inserts into opening in the gear.

49. A troffer light fixture as recited in claim 48, wherein the arms comprise gear racks, wherein the gear comprises an outer surface which provides gear teeth, wherein the gear teeth mesh with the gear racks that are provided on the arms, wherein the mesh provides that rotation of the rotatable member causes the gear racks to ride across the gear teeth on the gear, causing the arms to either extend or retract depending on which direction the rotatable member is rotated.

50. A troffer light fixture as recited in claim 49, wherein the arms have slots formed therein, wherein fasteners extend through the slots, and wherein the slots define a range of extension and retraction of the arms.

51. A troffer light fixture as recited in claim 41, wherein the blade provides a pinch area which receives the T-bar and pinches the T-bar against the back side of the housing during installation such that the troffer light fixture is frictionally engaged with the T-bar.

52. A troffer light fixture as recited in claim 41, wherein said blade on the back side of the housing comprises a plurality of blades.

53. A troffer light fixture as recited in claim 41, wherein the housing has a front side, wherein a trim ring is provided on the front side of the housing and the trim ring is configured to cover any opening that may otherwise exist between a previously installed troffer housing and a grid of the dropped ceiling.

* * * * *